US011692259B2

(12) United States Patent
Sohn et al.

(10) Patent No.: US 11,692,259 B2
(45) Date of Patent: Jul. 4, 2023

(54) HIGH-STRENGTH HOT-DIP ZINC PLATED STEEL MATERIAL HAVING EXCELLENT PLATING PROPERTIES AND METHOD FOR PREPARING SAME

(71) Applicant: POSCO, Pohang-si (KR)

(72) Inventors: Il-Ryoung Sohn, Gwangyang-si (KR); Dae-Young Kang, Gwangyang-si (KR); Jong-Sang Kim, Gwangyang-si (KR); Tae-Chul Kim, Gwangyang-si (KR); Min-Suk Oh, Gwangyang-si (KR)

(73) Assignee: POSCO, Pohang-si (KR)

( * ) Notice: Subject to any disclaimer, the term of this patent is extended or adjusted under 35 U.S.C. 154(b) by 0 days.

(21) Appl. No.: 17/694,942

(22) Filed: Mar. 15, 2022

(65) Prior Publication Data

US 2022/0195575 A1 Jun. 23, 2022

Related U.S. Application Data

(62) Division of application No. 16/064,757, filed as application No. PCT/KR2016/014983 on Dec. 21, 2016, now Pat. No. 11,306,381.

(30) Foreign Application Priority Data

Dec. 24, 2015 (KR) ..... 10-2015-0186561

(51) Int. Cl.
*C23C 2/06* (2006.01)
*C23C 2/40* (2006.01)
(Continued)

(52) U.S. Cl.
CPC ..... *C23C 2/06* (2013.01); *C21D 6/005* (2013.01); *C21D 6/008* (2013.01); *C22C 38/00* (2013.01);
(Continued)

(58) Field of Classification Search
None
See application file for complete search history.

(56) References Cited

U.S. PATENT DOCUMENTS 6,398,884 B1 * 6/2002 Kyono ..... C21D 8/04 148/653
8,999,084 B2 4/2015 Fushiwaki
(Continued)

FOREIGN PATENT DOCUMENTS

CN 103228812 B 7/2013
CN 104419867 B 3/2015
(Continued)

OTHER PUBLICATIONS

U.S. Notice of Allowance dated Dec. 15, 2021 dated in U.S. Appl. No. 16/064,757.
(Continued)

*Primary Examiner* — Daniel J. Schleis
(74) *Attorney, Agent, or Firm* — Morgan, Lewis & Bockius LLP

(57) ABSTRACT

Provided are a hot-dip zinc plated steel material and a method for preparing same, the hot-dip zinc plated steel material comprising: base iron comprising 0.01-1.6 wt % of Si and 1.2-3.1 wt % of Mn; a Zn—Al—Mg alloy plating layer; and an Al-rich layer formed on the interface of the base iron and Zn—Al—Mg alloy plating layer, wherein the rate of occupied surface area of the Al-rich layer is 70% or higher (including 100%).

21 Claims, 2 Drawing Sheets

(51) Int. Cl.

| | |
|---|---|
| ***C22C 38/02*** | (2006.01) |
| ***C22C 38/04*** | (2006.01) |
| ***C22C 38/06*** | (2006.01) |
| ***C23C 2/02*** | (2006.01) |
| ***C22C 38/00*** | (2006.01) |
| ***C23C 2/26*** | (2006.01) |
| ***C21D 6/00*** | (2006.01) |
| ***C23C 2/12*** | (2006.01) |
| *C22C 38/22* | (2006.01) |
| *C22C 38/26* | (2006.01) |
| *C22C 38/28* | (2006.01) |
| *C22C 38/30* | (2006.01) |
| *C22C 38/32* | (2006.01) |

(52) U.S. Cl.

CPC ..... *C22C 38/001* (2013.01); *C22C 38/02* (2013.01); *C22C 38/04* (2013.01); *C22C 38/06* (2013.01); *C23C 2/02* (2013.01); *C23C 2/12* (2013.01); *C23C 2/26* (2013.01); *C23C 2/40* (2013.01); *C22C 38/22* (2013.01); *C22C 38/26* (2013.01); *C22C 38/28* (2013.01); *C22C 38/30* (2013.01); *C22C 38/32* (2013.01)

(56) References Cited

U.S. PATENT DOCUMENTS

| | | | | |
|---|---|---|---|---|
| 9,315,887 | B2 * | 4/2016 | Fushiwaki | C21D 9/561 |
| 9,598,756 | B2 * | 3/2017 | Oohashi | C23C 2/12 |
| 2010/0139816 | A1 | 6/2010 | Hanlon et al. | |
| 2011/0177253 | A1 | 7/2011 | Oohashi et al. | |
| 2012/0152411 | A1 | 6/2012 | Morimoto et al. | |
| 2013/0206284 | A1 * | 8/2013 | Norden | C23C 2/02 148/217 |
| 2013/0236739 | A1 | 9/2013 | Yoshida et al. | |
| 2014/0120366 | A1 | 5/2014 | Sohn | |
| 2015/0071811 | A1 | 3/2015 | Jensen et al. | |
| 2015/0159253 | A1 | 6/2015 | Oh et al. | |
| 2016/0024632 | A1 | 1/2016 | Uranaka et al. | |
| 2016/0376679 | A1 | 12/2016 | Kim et al. | |

FOREIGN PATENT DOCUMENTS

| | | | | |
|---|---|---|---|---|
| CN | 104838035 | A | | 8/2015 |
| EP | 2644736 | A1 | | 10/2013 |
| EP | 2728032 | A2 | | 5/2014 |
| JP | H04-318157 | A | | 11/1992 |
| JP | 2003277904 | A | | 10/2003 |
| JP | 2007239012 | A | | 9/2007 |
| JP | 2010519415 | A | | 6/2010 |
| JP | 2010255113 | A | | 11/2010 |
| JP | 2014527120 | A | | 10/2014 |
| JP | 2014208902 | A | | 11/2014 |
| JP | 2014221943 | A | | 11/2014 |
| JP | 2015036426 | A | * | 2/2015 |
| JP | 2015531817 | A | | 11/2015 |
| KR | 10-1115816 | B1 | | 3/2012 |
| KR | 10-2012-0041619 | A | | 5/2012 |
| KR | 10-1324836 | B1 | | 11/2013 |
| KR | 10-2014-0051669 | A | | 5/2014 |
| KR | 10-2015-0000895 | A | | 1/2015 |
| KR | 10-2015-0074882 | A | | 7/2015 |
| KR | 10-2015-0075323 | A | | 7/2015 |
| KR | 10-1569505 | B1 | | 11/2015 |
| WO | 2008/102009 | A1 | | 8/2008 |
| WO | 2011/025042 | A1 | | 3/2011 |
| WO | 2013/149732 | A1 | | 10/2013 |

OTHER PUBLICATIONS

Chinese Office Action—Chinese Application No. 201680076292.4 dated Aug. 5, 2019.

Japanese Office Action—Japanese Application No. 2018-532627 dated Jul. 16, 2019.

E. Baril, et al., "Studies of the morphology of the Al-rich interfacial layer formed during the hot dip galvanizing of steel sheet," Metall Mater Trans A., vol. 30, pp. 681-695, (Year: 1999).

European Search Report—European Application No. 16879316.4, dated Oct. 2, 2018.

U.S. Notice of Allowance dated Mar. 15, 2022 issued in U.S. Appl. No. 16/064,757.

* cited by examiner

HIGH-STRENGTH HOT-DIP ZINC PLATED STEEL MATERIAL HAVING EXCELLENT PLATING PROPERTIES AND METHOD FOR PREPARING SAME

CROSS-REFERENCE OF RELATED APPLICATIONS

This application is a divisional of U.S. patent application Ser. No. 16/064,757, filed on Jun. 21, 2018, which is the U.S. National Phase under 35 U.S.C. § 371 of International Patent Application No. PCT/KR2016/014983, filed on Dec. 21, 2016, which in turn claims the benefit of Korean Patent Application No. 10-2015-0186561, filed on Dec. 24, 2015, the entire disclosures of which applications are incorporated by reference herein.

TECHNICAL FIELD

The present disclosure relates to a high-strength hot-dip zinc plated steel material having excellent plating properties and a method for preparing the same.

BACKGROUND ART

Since high-strength steels contain a higher amount of elements such as Si, Mn, or the like that have a stronger tendency for oxidation than general steels, oxides may be easily formed on the surface during annealing and may interfere with plating.

Such surface oxides tend to inhibit a chemical reaction between the plating bath and the base steel during zinc plating. Accordingly, a technique has recently been proposed, in which plating properties are enhanced through controlling the composition and the ratio of the surface oxide to be favorable for plating by controlling the annealing conditions (See Patent Document 1: Korea Patent Publication No. 10-2014-0061669).

Meanwhile, zinc-based plating that includes Al and Mg contains a higher amount of Al and Mg, as compared to ordinary zinc plating, which results in a considerably different reaction between the base steel and the plating bath, but to date, no technique has been suggested for enhancing the plating properties of a zinc plated steel sheet with a high-strength steel as a base.

DISCLOSURE

Technical Problem

An aspect of the present disclosure is to provide a high-strength hot-dip zinc plated steel material having excellent plating properties and a method for preparing the same.

Technical Solution

According to an aspect of the present disclosure, a high-strength hot-dip zinc plated steel material may include: a base steel containing 0.01 wt % to 1.6 wt % of Si and 1.2 wt % to 3.1 wt % of Mn; a Zn—Al—Mg alloy plating layer; and an Al-rich layer formed at the interface of the base steel and the Zn—Al—Mg alloy plating layer, in which the rate of a surface area occupied by of the Al-rich layer is 70% or higher (including 100%).

According to another aspect of the present disclosure, a method for preparing a high-strength hot-dip zinc plated steel material may include: preparing a base steel containing 0.01 wt % to 1.6 wt % of Si and 1.2 wt % to 3.1 wt % of Mn; annealing the base steel at a temperature of 760° C. to 850° C. under the condition of a dew point temperature of −60° C. to −10° C.; and immersing the annealed base steel in a Zn—Al—Mg zinc plating bath and plating to obtain a high-strength hot-dip zinc plated steel material.

Advantageous Effects

As set forth above, according to an exemplary embodiment in the present disclosure, one of several advantageous effects of a high-strength hot-dip zinc plated steel material is excellent plating properties.

The various and beneficial advantages and effects of the present disclosure are not limited to the above description, and can be more easily understood in the course of describing a specific embodiment of the present disclosure.

BEST MODE FOR INVENTION

Figure 1:
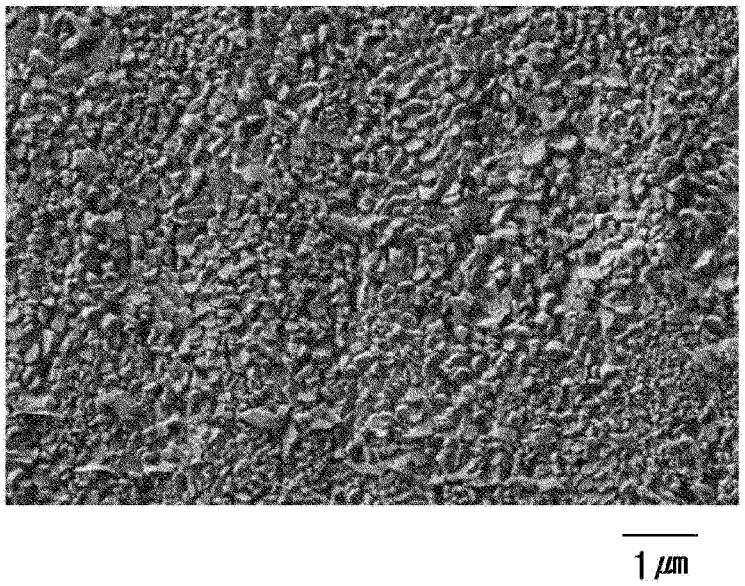
FIG. 1 is a Scanning Electron Microscope (SEM) image for observation of an interfacial layer of a hot-dip zinc plated steel material according to Inventive Example 7.

Hereinafter, a high-strength hot-dip zinc plated steel material having excellent plating properties according to one aspect of the present disclosure will be described in detail.

The hot-dip zinc plated steel material according to the present disclosure includes a base steel and a Zn—Al—Mg plating layer. In this example, the base steel may be a steel sheet or a steel wire.

In the present disclosure, the composition of the base steel is not particularly limited except for Si and Cr, but may include, for example: by weight percent, 0.05% to 0.25% of C, 0.01% to 1.6% of Si, 0.5% to 3.1% of Mn, 0.001% to 0.10% of P, 0.01% to 0.8% of Al, with a remainder of Fe and unavoidable impurities. It is to be noted in advance that the content of each component described below is on a weight basis unless otherwise specified.

C: 0.05% to 0.25%

Carbon (C) improves the strength of steel material and is a very useful element for ensuring a composite structure composed of ferrite and martensite. In order to obtain such an effect in the present disclosure, in an exemplary embodiment, the content of C may be 0.05% or higher, and more particularly, 0.07% or higher. However, when the content of C is excessive, the toughness and weldability of the steel material can be deteriorated. In order to prevent this, in one aspect, the content of C may be 0.25% or less, and more particularly, 0.23% or less.

Si: 0.01% to 1.6%

Silicon (Si) is a useful element for ensuring strength without compromising the ductility of the steel material. In addition, Si is an element that promotes the formation of ferrite, and promotes formation of martensite by encouraging carbon concentration to untransformed austenite. In order to obtain such an effect in the present disclosure, in an exemplary embodiment, the content of Si may be 0.01% or higher, and more particularly, 0.05% or higher. However, when the content of Si is excessive, surface characteristics and weldability may be deteriorated. In order to prevent this, in one aspect, the content of Si may be 1.6% or less, and more particularly, 1.4% or less.

Mn: 0.5% to 3.1%

Manganese (Mn) is a solid solution strengthening element, and it not only contributes greatly to the strength, but also plays a role of promoting the formation of a composite structure composed of ferrite and martensite. In order to obtain such an effect in the present disclosure, in an exemplary embodiment, the content of Mn may be 0.5% or higher, and more particularly, 1.2% or higher. However, when the content of Mn is excessive, the weldability and hot rolling property may be deteriorated. In order to prevent this, in one aspect, the content of Mn may be 3.1% or less, and more particularly, 2.9% or less.

P: 0.001% to 0.10%

Along with manganese, phosphorus (P) is also a typical solid solution strengthening element that is added to improve the strength of steel material. In order to obtain such an effect in the present disclosure, in an exemplary embodiment, the content of P may be 0.001% or higher, and more particularly, 0.01% or higher. However, when the content of P is excessive, it can not only deteriorate the weldability, but also cause the material deviations at respective sites of the steel material due to the center segregation occurring during continuous casting. In order to prevent this, in one aspect, the content of P may be 0.10% or less, and more particularly, 0.07% or less.

Al: 0.01% to 0.8%

Aluminum (Al) is usually added for deoxidation of steel, but in the present disclosure, it is added to improve ductility. Furthermore, Al plays a role of suppressing the carbide formed in the austempering process and increasing the strength. In order to obtain such an effect in the present disclosure, in an exemplary embodiment, the content of Al may be 0.01% or higher, and more particularly, 0.02% or higher. However, when the content of Al is excessive, internal oxidation is developed during annealing of the cold-rolled sheet, which may interfere with the alloying during the alloying heat treatment and may excessively increase the alloying temperature. In order to prevent this, in one aspect, the content of Al may be 0.8% or less, and more particularly, 0.6% or less.

N: 0.001% to 0.03%

Nitrogen (N) is useful for stabilizing austenite. In order to obtain such an effect in the present disclosure, in an exemplary embodiment, the content of N may be 0.001% or higher, and more particularly, 0.002% or higher. However, when the content of N is excessive, the coarse AlN may be crystallized due to the reaction with Al in the steel, which may deteriorate the mechanical properties of the steel material. In order to prevent this, in one aspect, the content of N may be 0.03% or less, and more particularly, 0.02% or less.

Fe is a remainder other than the composition described above. However, in the typical manufacturing process, unintended impurities cannot be avoided since they can be inevitably incorporated from the raw material or the surrounding environment. All these impurities will not be specifically mentioned in the present disclosure, since they would be well known to those with ordinary knowledge in the art.

However, S, which is a representative example of the impurity, can deteriorate ductility when the S content in the base steel increases, the S content may be controlled to be 0.03% or less.

Meanwhile, addition of an effective component other than the composition mentioned above is not excluded. For example, the base steel may further include one or more selected from the group consisting of: 0.9% or less of Cr (excluding 0%), 0.004% or less of B (excluding 0%), 0.1% or less of Mo (excluding 0%), 1.0% or less of Co (excluding 0%), 0.2% or less of Ti (excluding 0%), and 0.2% or less of Nb (excluding 0%).

Cr: 0.9% or less (excluding 0%)

Chromium (Cr) plays a role of improving the strength of steel material and improving hardenability. However, when the content of Cr is excessive, the effect can be saturated, and the ductility of the steel material can also deteriorate. In order to prevent this, in one aspect, the content of Cr may be 0.9% or less, and more particularly, 0.8% or less.

B: 0.004% or less (excluding 0%)

Boron (B) is a grain boundary strengthening element which plays a role of improving the fatigue characteristics of spot welds, preventing grain boundary embrittlement by phosphorus, and delaying transformation of austenite into pearlite in cooling during annealing. However, when the content of B is excessive, the workability of the steel material is deteriorated, B can be excessively concentrated on the surface thereof, resulting in deterioration of the plating adhesion ability. In order to prevent this, in one aspect, the content of B may be 0.004% or less, and more particularly, 0.003% or less.

Mo: 0.1% or less (excluding 0%)

Molybdenum (Mo) plays a role of improving resistance to secondary work embrittlement and plating properties. However, when the content of Mo exceeds 0.1%, the effect is saturated. Accordingly, in the present disclosure, the content of Mo may be 0.1% or less.

Co: 1.0% or less (excluding 0%)

Cobalt (Co) plays a role of improving the strength of the steel material and suppressing the formation of oxides during high-temperature annealing, thereby improving the wettability of molten zinc. However, when the content of Co is excessive, the ductility of the steel material can be drastically deteriorated. In order to prevent this, in one aspect, the content of Co may be 1.0% or less, and more particularly, 0.5% or less.

Ti: 0.2% or less (excluding 0%)

Titanium (Ti) is a useful element for increasing the strength of the steel material and reducing grain size. However, when the content of Ti is excessive, the production costs can be increased, and also the ductility of the ferrite can be deteriorated due to the formation of excessive precipitates. In order to prevent this, in one aspect, the content of Ti may be 0.2% or less, and more particularly, 0.1% or less.

Nb: 0.2% or less (excluding 0%)

Like Ti, niobium (Nb) is a useful element for increasing the strength of steel materials and reducing grain size. However, when the content of Nb is excessive, the production costs can be increased, and also the ductility of the ferrite can be deteriorated due to the formation of excessive precipitates. In order to prevent this, in one aspect, the content of Nb may be 0.2% or less, and more particularly, 0.1% or less.

The Zn—Al—Mg plating layer is formed on the surface of the base steel to prevent corrosion of the base steel under the corrosive environment. In the present disclosure, the composition of the Zn—Al—Mg plating layer is not particularly limited, but may include, for example: by weight percent, 0.5% to 3.5% of Mg, 0.2% to 15% of Al, with a remainder of Zn and other unavoidable impurities.

Mg plays a very important role in improving the corrosion resistance of hot-dip zinc plated steel material and Mg effectively prevents the corrosion of hot-dip zinc plated steel material by forming dense zinc hydroxide corrosion products on the surface of the plating layer under corrosive environment. In order to ensure the effect of corrosion resistance of the present disclosure, the content of Mg should be 0.5 wt % or higher, and more particularly, 0.9 wt % or higher. However, when the content of Mg is excessive, Mg oxidizing dross rapidly increases on the surface of the plating bath, compromising the antioxidant effect of the addition of the trace elements. In order to prevent this, in one aspect, the content of Mg should be 3.5 wt % or less, and more particularly, 3.2 wt % or less.

Al suppresses the formation of Mg oxide dross in the plating bath and reacts with Zn and Mg in the plating bath to form a Zn—Al—Mg intermetallic compound, thus improving the corrosion resistance of the plated steel material. In order to achieve such an effect in the present disclosure, the content of Al should be 0.2 wt % or higher, and more particularly, 0.9 wt % or higher. However, when the content of Al is excessive, the weldability and phosphatizing property of the plated steel material can be deteriorated. In order to prevent this, in one aspect, the content of Al should be 15 wt % or less, and more particularly, 12 wt % or less.

The hot-dip zinc plated steel material of the present disclosure includes an Al-rich layer formed at the interface of the base steel and the Zn—Al—Mg alloy plating layer, and is characterized in that the rate of occupied surface area of the Al-rich layer is 70% or higher (including 100%), and more particularly, 73% or higher (including 100%). The "rate of occupied surface area" as used herein refers to a ratio of the surface area of the Al-rich layer to the surface area of the base steel on a plane assumed regardless of three-dimensional bending or the like, when projected from the surface of the plated steel material in a thickness direction of the base steel.

The general understanding has been that a hot-dip zinc plated steel sheet having a high-strength steel including a high amount of Si and Mn as a base proposed in the present disclosure is inferior in terms of plating properties and plating adhesion ability. Accordingly, the inventors of the present disclosure have conducted intensive studies to solve this problem, and as a result, found that the deterioration of the plating properties and the plating adhesion ability of a hot-dip zinc plated steel sheet having a high-strength steel including a high amount of Si and Mn as a base, is attributable to the non-dense, coarse Al-rich layer formed at the interface of the base steel and the plating layer due to the annealing oxide formed on the surface of the base steel. Furthermore, we have also found that, when the rate of occupied surface area of the Al-rich layer is 70% or higher, the Al-rich layer has a shape in which fine particles are continuously formed, thus remarkably improving the plating properties and the plating adhesion ability.

In some examples, Al may exist in the Al-rich layer in combination with Fe in a ratio close to the stoichiometric ratio of the intermetallic compound. For example, a majority of the compounds may exist in the form of $Al_4Fe_{13}$, while the rest exist in the form of $Al_5Fe_2$.

According to one example, the sum of the contents of Al and Fe contained in the Al-rich layer may be 50 wt % or higher (excluding 100 wt %), and 65 wt % or less (excluding 100 wt %). If the sum of the contents of Al and Fe is less than 50 wt %, the Al-rich layer may not be uniformly formed due to the influence of impurity elements, or the physical bonding force between the base steel and the plating layer can be weakened, thus resulting in locally incompletely formed plating layer or deteriorated plating adhesion ability.

Meanwhile, the Al-rich layer further contains impurity elements such as O, Si, Mn or Cr in addition to Al and Fe, and these impurity elements are residues of annealed oxides or those that are diffused from the base steel and remain in the Al-rich layer. More specifically, when the base steel is brought into contact with the liquid plating bath, Mg and Al in the plating bath components reduce the oxide of the base steel surface. Through this reduction process, some of oxygen is discharged from the oxide, and some of the reduced metal is dissolved in the plating bath, while some of them is alloyed on the surface of the base steel. Meanwhile, almost simultaneously with the reduction of the oxide, Al among the plating bath components directly reacts with the base steel to form an Al-rich layer. Ideally, the oxides on the surface of the base steel are completely reduced and depleted, but in practice, some of the oxides is left as small pieces in unreduced state, under or within the Al-rich layer that is formed. In addition, when the base steel reacts with Al, the components of the base steel, that is, Mn, Si, and Cr are incorporated into the Al-rich layer. In addition, Zn, which is the main component of the plating bath, and Si, which is trace impurity of the plating bath, and the like are also incorporated into the Al-rich layer.

According to one example, the Al-rich layer may have I as defined by Equation 1 or 2 below to be 0.40 or less, and more particularly, 0.38 or less, and even more particularly, 0.35 or less. Equation 1 below is applied when the base steel does not contain Cr, and Equation 2 is applied when the base steel contains Cr.

$$I = [O]/\{[Si] + [Mn] + [Fe]\} \quad \text{[Equation 1]}$$

$$I = [O]/\{[Si] + [Mn] + [Cr] + [Fe]\} \quad \text{[Equation 2]}$$

(where, each of [O], [Si], [Mn], [Cr] and [Fe] denote the content (wt %) of the corresponding element contained in the Al-rich layer).

Equations 1 and 2 are conditional expressions for ensuring the 70% or higher rate of occupied surface area of the Al-rich layer, and the higher the I value expresses higher residual ratio of annealed oxide in the Al-rich layer. Meanwhile, since the lower I value is more advantageous for ensuring the rate of occupied surface area of the Al-rich layer, the lower limit thereof is not particularly limited in the present disclosure.

In the present disclosure, an apparatus and a method for measuring the contents of oxygen and metal elements contained in the Al-rich layer are not particularly limited, although the measurement may be obtained using, for example, Glow Discharge Optical Emission Spectrometry (GDOES). At this time, the element to be analyzed may be analyzed after calibrating the analytical equipment using standard samples. Meanwhile, since the Al-rich layer is present at the interface of the base steel and the Zn—Al—Mg plating layer as described above, it is difficult to confirm the structure thereof, or the like, unless the Zn—Al—Mg plating layer is removed. Accordingly, the Zn—Al—Mg plating layer may be entirely dissolved by immersing zinc plated steel in a chromic acid solution capable of chemically dissolving only the upper Zn—Al—Mg plating layer without damaging the Al-rich layer for 30 seconds, after which the contents of oxygen and metal elements contained in the resultant Al-rich layer may be measured using Glow Discharge Optical Emission Spectrometry (GDOES). In one example, the chromic acid solution may be prepared by mixing 200 g of $CrO_3$, 80 g of $ZnSO_4$ and 50 g of $HNO_3$ in 1 liter of distilled water.

Meanwhile, for analysis from the surface of the analytical sample to the inside, the reference of the Al-rich layer may necessarily be based on a point at which Fe is observed in an amount ranging from 0 wt % to 84 wt %. It is because the point where the content of Fe is 84 wt % or higher cannot be considered as the Al-rich layer area since it is greatly influenced by the base steel.

Meanwhile, as a result of further studies by the present inventors, it has been found that if the ratio ([Si]/[Mn]) of the content of Si to the content of Mn contained in the base steel is 0.3 or higher, it is necessary to induce internal oxidation of Si to reduce the content of Si in the annealed oxide in order to ensure the intended I value. This is considered to be because $SiO_2$, which is a relatively stable compound as compared with MnO, does not easily reduced or decomposed in the plating bath.

According to one example, when the ratio ([Si]/[Mn]) of the content of Si to the content of Mn contained in the base steel is 0.3 or higher, the base steel may include an internal oxide layer formed directly below the surface thereof, in which case the average thickness (nm) of the internal oxide layer may be 100×[Si]/[Mn] or greater.

Since the greater average thickness (nm) of the internal oxide layer is more advantageous for the reduction of the Si content in the annealed oxide of the steel surface, the upper limit thereof is not particularly limited in the present disclosure. However, it is also possible that excessive thickness can cause cracking defects during hot-dip coating, because elements such as Al and Mg reduce the internal oxide, penetrating deeply into the steel surface along the internal oxide. In order to prevent the above, in one aspect, the upper thickness limit may be limited to 1,500 nm, and specifically, to 1,450 nm.

The kind of the oxide constituting the internal oxide layer is not particularly limited, but for example, the internal oxide layer may include Si single oxide and Si—Mn composite oxide.

According to one example, b/a>1 may be satisfied, where 'a' is a ratio of the Si content to the Mn content contained in the internal oxide layer of Si and Mn, and 'b' is a ratio of the Si content to the Mn content contained in the base steel excluding the internal oxide layer of Si and Mn. In this way, controlling the value of b/a above 1 may be advantageous for ensuring that an intended I value is obtained.

The high-strength hot-dip zinc plated steel material of the present disclosure described above may be produced by various methods which are not particularly limited. However, for the purpose of illustration, the high-strength hot-dip zinc plated steel material may be prepared by the method described below.

Hereinafter, a method for preparing a high-strength hot-dip zinc plated steel material having excellent plating properties according to another aspect of the present disclosure will be described in detail.

First, a base steel of alloy composition described above is prepared.

According to one example, the base steel may be a cold-rolled steel sheet, and in this case, the surface roughness (Ra) of the cold-rolled steel sheet may be 2.0 μm or less. The results of studies done by the present inventors indicate that the greater surface roughness of the base steel before plating leads into the greater surface area and dislocation density, thus resulting in formation of oxides unfavorable to the surface reaction during hot-dip coating, which may be detrimental to the formation of the intended Al-rich layer. Meanwhile, lower surface roughness of the base steel is more advantageous for the formation of the intended Al-rich layer, and therefore, the lower limit is not particularly limited in the present disclosure. However, it is also possible that the excessively low surface roughness of the base steel can hinder the production process due to slip of the steel during rolling. Accordingly, in order to prevent the above, in one aspect, the lower limit may be limited to 0.3 μm.

Next, the base steel is annealed. The annealing is carried out in order to recover the recrystallization of the base steel structure, and the annealing may be carried out at a temperature of 760 to 850° C., which is sufficient degree to recover the recrystallization of the base steel structure.

At this time, it is important to control the dew point temperature to form the intended Al-rich layer. This is because the change in the dew point temperature not only varies the proportions of the components constituting the oxide film formed on the base steel surface, but also varies the internal oxidation ratio, and according to the present disclosure, the dew point temperature is controlled at −60° C. to −10° C. If the dew point temperature is less than −60° C., more stable $SiO_2$ oxide will form a dense oxide film on the surface of the base steel, in which case the MnO with a high growth rate of the oxide is not likely to occur, the reduction and decomposition of the oxide film is also not likely to occur during the subsequent hot-dip coating, and as a result, it is difficult to form the intended Al-rich layer. On the other hand, when the dew point is higher than −10° C., less $SiO_2$ is produced on the base steel surface, while the internal oxidation occurs excessively, in which case the average thickness of the internal oxide layer is excessively increased and cracking defects can occur.

If the ratio ([Si]/[Mn]) of the content of Si to the content of Mn contained in the base steel is 0.3 or higher, the dew point temperature during annealing may be controlled between −40° C. and −10° C., and more particularly, between −30° C. and −15° C. This is to reduce the Si content in the annealed oxide by forming an internal oxide layer of appropriate thickness.

According to one example, the annealing may be performed at an atmosphere of 3 vol % to 30 vol % of hydrogen gas and the balance being nitrogen gas. With less than 3 vol % of the hydrogen gas, it may be difficult to effectively suppress the surface oxide, and on the other hand, more than 30 vol % of the hydrogen gas can lead to not only the increased expenditure due to the increased hydrogen content, but also the drastically increased risk of the explosion.

Next, the base steel after annealing is immersed in a Zn—Al—Mg plating bath and plated to obtain a high-strength hot-dip zinc plated steel material. In the present disclosure, a specific method of obtaining a high-strength hot-dip zinc plated steel material is not particularly limited, although the following method may be used to further maximize the effect of the present disclosure.

According to the results of the studies conducted by the present inventors, in order for the Si, Mn oxides or the like formed on the surface of the base steel in the annealing process to be effectively decomposed during the plating process, and the Al-rich layer to be uniformly formed on the surface of the base steel, it is necessary to manage the plating bath temperature, the surface temperature of the base steel brought into the plating bath, the dross defect formed on the surface or inside of the plating bath, and the like.

(a) Plating bath temperature and the surface temperature of the base steel introduced into the plating bath The temperature of the plating bath may be maintained, for example, at 430° C. or higher, and more particularly, at 440° C. or higher, in order to ensure uniform mixing and flow of the constituent elements in the plating bath. Meanwhile, the higher the temperature of the plating bath is, the better the plating properties are. However, if the temperature is excessively high, there arises a problem that the oxidation of Mg occurs from the surface of the plating bath and that the outer wall of the plating port is eroded from the plating bath. In order to prevent this, the temperature of the plating bath may be maintained, for example, at 470° C. or lower, and specifically, at 460° C. or lower.

In addition, the surface temperature of the base steel introduced into the plating bath should be equal to or higher than the plating bath temperature, which is advantageous in terms of the decomposition of the surface oxide and Al concentration. Particularly, in order to maximize the effect of the present disclosure, the surface temperature of the base steel introduced into the plating bath may be controlled, for example, at 5° C. or higher relative to the plating bath temperature, and more particularly, at 15° C. or higher relative to the plating bath temperature. However, when the surface temperature of the base steel introduced into the plating bath is excessively high, it may be difficult to control the temperature of the plating port, and the base steel component may be excessively eluted into the plating bath. Accordingly, the upper limit of the temperature may be controlled so as not to exceed 30° C. relative to the plating bath temperature, and more particularly, the upper limit may be controlled so as not to exceed 20° C. relative to the plating bath temperature.

(b) Dross management of plating bath

In the plating bath, in addition to the uniform liquid phase, there also exist solid dross defects mixed therein. Particularly, on the surface of the plating bath, dross having a $MgZn_2$ component as a main component is present in the form of a floating dross on the surface of the plating bath, due to the Al and Mg oxides and the cooling effect. The dross incorporated into the surface of the plating steel sheet not only causes defects on the plating layer, but also hinders the formation of the Al-rich layer formed at the interface of the plating layer and the base steel. It is necessary to control the atmospheric atmosphere above the surface of the plating bath to 3 vol % or less of oxygen (including 0 vol %) with a remainder of inert gas atmosphere, in order to decrease oxides and floating dross formed on the surface. In addition, it is necessary to prevent the surface of the plating bath from a direct contact with the outside cool air. This is in consideration of the fact that decomposition of intermetallic compounds such as $MgZn_2$ does not occur easily when the external cold air is in direct contact with the surface of the plating bath.

As described above, in one example, in order to control the plating bath surface atmosphere and prevent direct contact with the cold atmosphere, a sealing box may be installed at a location where the base steel introduced into the plating bath is drawn out to the outside of the plating bath.

Figure 3:
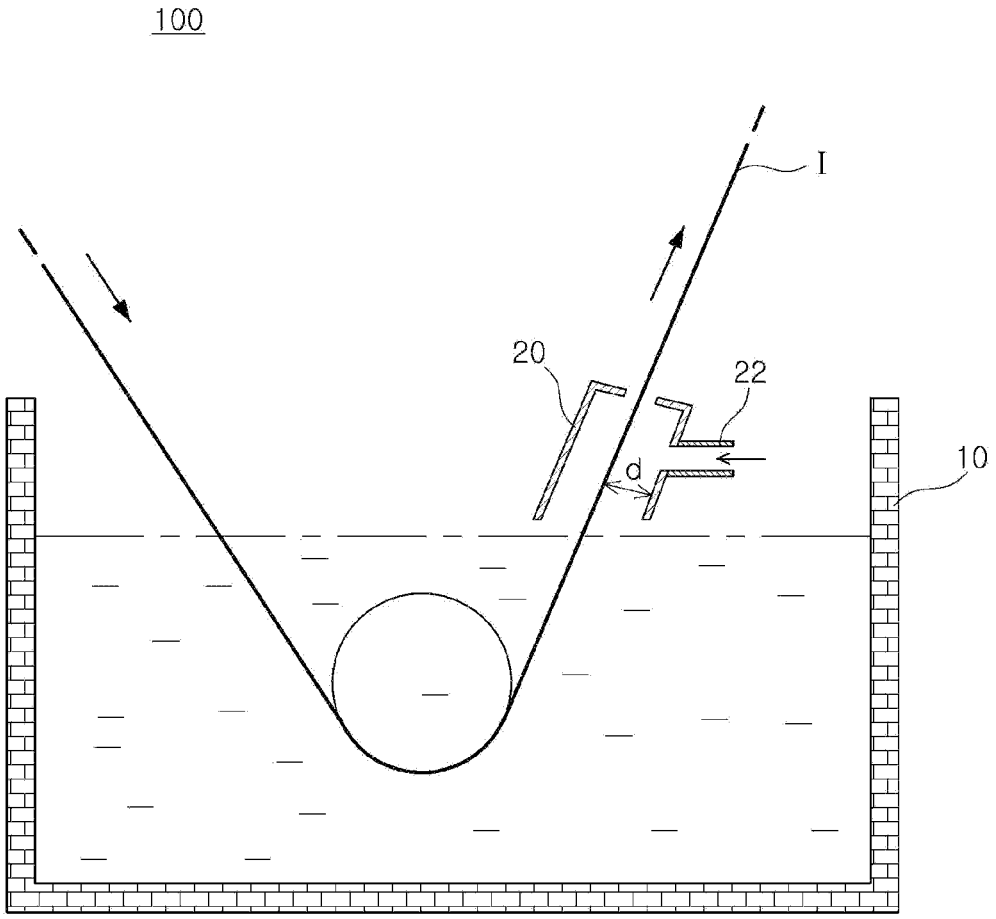
FIG. 3 is a schematic view illustrating a hot-dip coating apparatus provided with a sealing box.

FIG. 3 is a schematic view illustrating a hot-dip coating apparatus provided with a sealing box. Referring to FIG. 3, a sealing box may be formed on the plating bath surface at a location where the base steel is drawn out of the plating bath, and at one side of the sealing box, may be connected with a supply pipe for supplying inert gas.

Meanwhile, in this case, a spacing distance (d) between the base steel and the sealing box has to be limited to 5 cm to 100 cm. This is because, when the spacing distance is less than 5 cm, there is a risk that the plating solution would spatter due to the unstable atmosphere caused by the vibration of the base steel and the movement of the base steel in the narrow space, causing a plating defect, and when the spacing distance is greater than 100 cm, the management costs can be excessively increased.

BEST MODE FOR INVENTION

Hereinafter, the present disclosure will be described in more detail with reference to Examples. However, the description of certain Examples is for the purpose of illustrating the practice of the present disclosure only, and the present disclosure is not limited to any of the Examples described herein. This is because the scope of the present disclosure is determined by the matters described in the claims and the matters reasonably deduced therefrom.

A steel material having the composition (wt %) shown in Table 1 below was prepared, and then processed into a cold-rolled steel sheet having a thickness of 1.5 mm. Then, a plated steel material was prepared by carrying out annealing for 40 seconds at a temperature of 780° C. at the maximum under a nitrogen gas atmosphere containing 5 vol % hydrogen, followed by immersion in a zinc plating bath of the composition shown in Table 2. At this time, the temperature of the zinc plating bath was kept constant at 450° C.

Then, the plating appearance grade and the plating adhesion ability of each of the plated steel materials were evaluated and shown in Table 2 below. The specific criteria for evaluating plating appearance grade and plating adhesion ability are as follows.

[Plating appearance grades]

Grades were divided based on areas where uneven plating or non-plating had occurred, including Grade 1 in the absence of perceived defect, Grade 2 for uneven defect of 3 area % or less, Grade 3 for uneven defect of 15 area % or less, Grade 4 for uneven defect of 30 area % or less, and Grade 5 for uneven or non-plating defect of more than 30 area %.

[Plating adhesion ability]

Five samples were prepared for each plated steel material, and structural adhesive for use in automotive car was applied to 1 cm thickness on the surface of the samples. After drying, the steel sheet and the adhesive were separated by applying a physical force, and the evaluation followed based on the sites of fracture. Accordingly, evaluation was ◎ when the fracture occurred in the adhesive for all the samples, ○ when the fracture occurred at the interface of the adhesive and the plating layer in two or less samples, Δ when the delamination occurred in the plating layer in one or less sample, and X when the delamination occurred in the plating layer in two or more samples.

TABLE 1

| Steel type | C | Si | Mn | P | S | Al | Nb | B | Cr | Mo | Ti | Sb |
|---|---|---|---|---|---|---|---|---|---|---|---|---|
| Steel 1 | 0.08 | 0.13 | 1.70 | 0.02 | 0.0013 | 0.03 | 0.01 | 0.0006 | 0.33 | 0.003 | 0.001 | 0.02 |
| Steel 2 | 0.07 | 0.60 | 2.29 | 0.01 | 0.0015 | 0.04 | 0.05 | 0.0022 | 0.89 | 0.0094 | 0.019 | 0.03 |
| Steel 3 | 0.13 | 0.08 | 1.59 | 0.01 | 0.0008 | 0.02 | 0.03 | 0.0015 | 0.67 | 0.003 | 0.019 | 0.00 |
| Steel 4 | 0.07 | 0.01 | 1.70 | 0.02 | 0.0010 | 0.75 | 0.00 | 0.0000 | 0.00 | 0.000 | 0.000 | 0.00 |
| Steel 5 | 0.23 | 1.55 | 1.78 | 0.01 | 0.0020 | 0.01 | 0.01 | 0.0017 | 0.01 | 0.000 | 0.020 | 0.00 |
| Steel 6 | 0.23 | 0.45 | 1.25 | 0.01 | 0.0015 | 0.23 | 0.12 | 0.0035 | 0.25 | 0.003 | 0.005 | 0.00 |
| Steel 7 | 0.20 | 0.23 | 3.10 | 0.01 | 0.0010 | 0.05 | 0.12 | 0.0035 | 0.25 | 0.003 | 0.005 | 0.00 |

TABLE 2

| Examples | Type | Cold-rolled steel plate surface roughness | Dew point temp. during annealing (° C.) | Oxigen concentration on plating bath surface (voi%) | Plating bath composition (wt %) Mg | Plating bath composition (wt %) Al | Al-rich layer occupied surface area ratio (%) | | Si/Mn ratio (base iron) | Inner oxidation depth (nm) | Plating appearance (grade) | Adhesion |
|---|---|---|---|---|---|---|---|---|---|---|---|---|
| Ex. 1 | Steel 1 | 0.4 | −40 | 1 | 0.5 | 0.2 | 100 | 0.12 | 0.08 | 0 | 1 | ◎ |
| Ex. 2 | Steel 1 | 1.1 | −30 | 1 | 1.0 | 1.0 | 100 | 0.08 | 0.08 | 0 | 1 | ◎ |
| Ex. 3 | Steel 1 | 1.1 | −30 | 0.1 | 1.2 | 15.0 | 98 | 0.24 | 0.08 | 0 | 2 | ○ |
| Ex. 4 | Steel 2 | 1.5 | −30 | 0.1 | 1.6 | 1.6 | 75 | 0.32 | 0.26 | 0 | 2 | ○ |
| Ex. 5 | Steel 2 | 1.5 | −40 | 0.1 | 3.0 | 2.5 | 80 | 0.05 | 0.26 | 0 | 2 | ◎ |
| Ex, 6 | Steel 3 | 1.4 | −40 | 0.1 | 1.2 | 1.2 | 95 | 0.15 | 0.03 | 0 | 1 | ◎ |
| Ex. 7 | Steel 4 | 1.9 | −40 | 1 | 1.4 | 1.4 | 100 | 0.07 | 0.006 | 0 | 1 | ○ |
| Ex. 8 | Steel 5 | 1.3 | −30 | 1 | 1.4 | 1.4 | 98 | 0.13 | 0.87 | 90 | 3 | ○ |
| Ex. 9 | Steel 5 | 1.3 | −20 | 1 | 1.4 | 1.5 | 79 | 0.21 | 0.87 | 1400 | 2 | ○ |
| Ex. 10 | Steel 6 | 1.3 | −20 | 1 | 1.4 | 1.4 | 97 | 0.12 | 0.36 | 400 | 1 | ○ |
| Ex. 11 | Steel 7 | 1.3 | −50 | 3 | 1.5 | 1.5 | 100 | 0.10 | 0.08 | 0 | 1 | ◎ |
| Comp. Ex. 1 | Steel 1 | 2.3 | −30 | 3 | 1.0 | 1.0 | 60 | 0.37 | 0.08 | 0 | 4 | Δ |
| Comp. Ex. 2 | Steel 1 | 2.3 | −40 | 20 | 1.6 | 1.6 | 40 | 0.41 | 0.26 | 0 | 4 | X |
| Comp. Ex. 3 | Steel 2 | 1.5 | 0 | 1 | 1.2 | 15.0 | 65 | 0.51 | 0.26 | 1600 | 5 | Δ |
| Comp. Ex. 4 | Steel 3 | 1.4 | −10 | 1 | 3.0 | 2.5 | 55 | 0.36 | 0.03 | 0 | 4 | Δ |
| Comp. Ex. 5 | Steel 4 | 1.9 | −70 | 3 | 1.4 | 1.4 | 63 | 0.43 | 0.006 | 0 | 5 | X |
| Comp. Ex. 6 | Steel 5 | 1.3 | −80 | 3 | 1.4 | 1.4 | 40 | 0.60 | 0.87 | 0 | 5 | X |

Referring to Table 2, it can be seen that Inventive Examples 1 to 11 satisfying all the conditions proposed in the present disclosure exhibited the rate of occupied surface area of the Al-rich layer being controlled to 70% or higher, thereby confirming excellent plating properties and plating adhesion ability.

Figure 2:
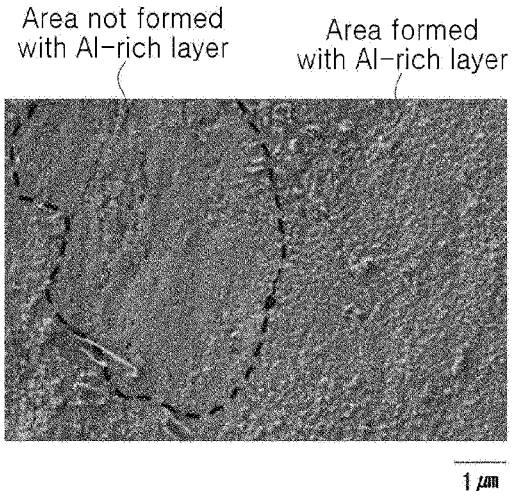
FIG. 2 is an SEM image for observation of an interfacial layer of the hot-dip zinc plated steel material according to Comparative Example 5.

Meanwhile, FIG. 1 is a Scanning Electron Microscope (SEM) image for observation of an interfacial layer of a hot-dip zinc plated steel material according to Inventive Example 7, and FIG. 2 is an SEM image for observation of an interfacial layer of the hot-dip zinc plated steel material according to Comparative Example 5.

While exemplary embodiments have been shown and described above, it will be apparent to those skilled in the art that modifications and variations could be made without departing from the scope of the present disclosure as defined by the appended claims.

The invention claimed is:

1. A method for preparing a high-strength hot-dip zinc plated steel material, comprising:

preparing a base steel including 0.05 to 0.25 wt % of C, 0.01 to 1.6 wt % of Si, 0.5 to 3.1 wt % of Mn, 0.001 to 0.10 wt % of P, 0.01 to 0.8 wt % of Al, 0.001 to 0.03 wt % of N, with a remainder of Fe and unavoidable impurities;

annealing the base steel at a temperature of 760° C. to 850° C. under the condition of a dew point temperature of −60° C. to −10° C.; and immersing the annealed base steel in a Zn—Al—Mg zinc plating bath and plating to obtain a high-strength hot-dip zinc plated steel material having a Zn—Al—Mg alloy plating layer comprising, by weight percent, 0.2% to 15% of Al, 0.5% to 3.5% of Mg, with a remainder of Zn and unavoidable impurities, and an interfacial layer formed at the interface of the base steel and the Zn—Al—Mg alloy plating layer, wherein a sum of contents of Al and Fe contained in the interfacial layer is 50 wt % or higher excluding 100 wt %, and wherein a rate of occupied surface area of the interfacial layer is 70% or higher including 100%.

2. The method of claim 1, wherein the base steel is a cold-rolled steel sheet and a surface roughness (Ra) of the cold-rolled steel sheet is 2.0 μm or less.

3. The method of claim 1, wherein a wt % ratio ([Si]/[Mn]) of the content of Si to the content of Mn contained in the base steel is 0.3 or higher, and the dew point temperature during the annealing is −40° C. to −10° C.

4. The method of claim 1, wherein the annealing is performed in an atmosphere of 3 vol % to 30 vol % of a hydrogen gas with a remainder of nitrogen gas.

5. The method of claim 1, wherein a temperature of the Zn—Al—Mg plating bath is 430° C. to 470° C.

6. The method of claim 1, wherein a surface temperature of the base steel immersed in the Zn—Al—Mg plating bath is 5° C. to 30° C. higher than the temperature of the Zn—Al—Mg plating bath.

7. The method of claim 1, wherein a surface atmosphere of the Zn—Al—Mg plating bath is an atmosphere of 3 vol % or less of oxygen with a remainder of inert gas.

8. The method of claim 1, wherein the base steel includes 0.05 to 0.23 wt % of C.

9. The method of claim 1, wherein the base steel includes 0.05 to 1.4 wt % of Si.

10. The method of claim 1, wherein the base steel includes 0.5 to 2.9 wt % of Mn.

11. The method of claim 1, wherein the base steel includes 0.001 to 0.07 wt % of P.

12. The method of claim 1, wherein the base steel includes 0.01 to 0.6 wt % of Al.

13. The method of claim 1, wherein the base steel includes 0.001 to 0.02 wt % of N.

14. The method of claim 1, wherein the base steel includes 0.03 wt % or less of S.

15. The method of claim 1, wherein the base steel includes more than 0 wt % and 0.09 wt % or less of Cr.

16. The method of claim 1, wherein the base steel includes more than 0 wt % and 0.004 wt % or less of B.

17. The method of claim 1, wherein the base steel includes more than 0 wt % and 0.1 wt % or less of Mo.

18. The method of claim 1, wherein the base steel includes more than 0 wt % and 0.2 wt % or less of Ti.

19. The method of claim 1, wherein the base steel includes more than 0 wt % and 0.2 wt % or less of Nb.

20. The method of claim 1, wherein high-strength hot-dip zinc plated steel material includes 0.5 wt % to 3.2 wt % of Mg.

21. The method of claim 1, wherein high-strength hot-dip zinc plated steel material includes 0.2% to 15% of Al.

* * * * *